US007741936B1

(12) United States Patent
Weller et al.

(10) Patent No.: US 7,741,936 B1
(45) Date of Patent: Jun. 22, 2010

(54) TUNABLE MICRO ELECTROMECHANICAL INDUCTOR

(75) Inventors: Thomas Weller, Lutz, FL (US); Balaji Lakshminarayanan, Tampa, FL (US); Srinath Balachandran, Tampa, FL (US)

(73) Assignee: University of South Florida, Tampa, FL (US)

( * ) Notice: Subject to any disclaimer, the term of this patent is extended or adjusted under 35 U.S.C. 154(b) by 343 days.

(21) Appl. No.: 11/849,703

(22) Filed: Sep. 4, 2007

Related U.S. Application Data

(63) Continuation-in-part of application No. 11/162,421, filed on Sep. 9, 2005, now Pat. No. 7,274,278.

(60) Provisional application No. 60/522,275, filed on Sep. 9, 2004.

(51) Int. Cl.
*H01P 1/10* (2006.01)
*H01P 3/08* (2006.01)

(52) U.S. Cl. ..... 333/262; 333/105

(58) Field of Classification Search ..... 333/101, 333/105, 262; 200/181
See application file for complete search history.

(56) References Cited

OTHER PUBLICATIONS

Balachandran et al., MEMS Tunable Planar Inductors Using DC-Contact Switches, 34th European Microwave Conference, 2004, pp. 713-716.*

* cited by examiner

*Primary Examiner*—Dean O Takaoka
(74) *Attorney, Agent, or Firm*—Molly L. Sauter; Smith & Hopen, P.A.

(57) ABSTRACT

The present invention provides a monolithic inductor developed using radio frequency micro electromechanical (RF MEMS) techniques. In a particular embodiment of the present invention, a tunable radio frequency microelectromechanical inductor includes a coplanar waveguide and a direct current actuatable contact switch positioned to vary the effective width of a narrow inductive section of the center conductor of the CPW line upon actuation the DC contact switch. In a specific embodiment of the present invention, the direct current actuatable contact switch is a diamond air-bridge integrated on an alumina substrate to realize an RF switch in the CPW and microstrip topology.

15 Claims, 7 Drawing Sheets

TUNABLE MICRO ELECTROMECHANICAL INDUCTOR

CROSS REFERENCE TO RELATED APPLICATIONS

This application is a continuation-in-part of co-pending U.S. patent application Ser. No. 11/162,421, "Tunable Micro Electromechanical Inductor", filed on Sep. 9, 2005 which claims priority to U.S. Provisional Patent Application No. 60/522,275, "A Tunable Micro Electromechanical Inductor", filed Sep. 9, 2004.

STATEMENT OF INTEREST

This work has been supported by National Science Foundation grant 2106-301-LO and Raytheon Systems grant 2106-315-LO.

BACKGROUND OF INVENTION

Micro-electro mechanical devices (MEMS) attract large attention in many fields of application that include the wireless, automotive and biomedical industries. Reliable RF-MEMS devices have been fabricated utilizing electrostatic and thermal actuation schemes.

The design of microwave and millimeter wave electronics requires components that provide a capability for impedance matching, and/or tuning. Impedance matching is the process through which signals are made to propagate through a high frequency network with a specific amount of reflection, typically as low as possible.

Two of the most common types of components used for impedance matching are capacitors and inductors. Radio frequency micro electromechanical (RF MEMS) techniques have in the past been used to fabricate state-of-the-art tunable capacitors in a variety of different forms. However, to date much less progress has been made in developing RF MEMS tunable inductors.

Prior art in tunable inductors of the RF MEMS type basically consist of topologies in which RF MEMS switches are used to select between different tuning states. Inductors are integral components in RF front end architectures that include filters, matching networks and tunable circuits such as phase shifters. The most common inductor topologies include planar spirals, aircore, and embedded solenoid designs. In comparison to capacitors, however, relatively few tunable inductor configurations have been published; among those presented, many are hybrid approaches that employ MEMS switches to activate different static inductive sections. Furthermore, less attention has been paid to designs that enable control in the sub-nH range as is potentially desirable for matching purposes in applications that use distributed loading of small capacitances, e.g. in loaded-line phase shifters.

Nanocrystalline diamond (NCD) possesses many outstanding material properties such as high thermal conductivity, high stiffness, low thermal expansion coefficient and its chemical inertness prevents from oxidation (up to ~600° C. in vacuum). These properties of NCD films can be used for high temperature and high power RF-MEMS devices. Furthermore, NCD films also possess low loss when used as a thin film at microwave frequencies.

Accordingly what is needed in the art is an improved tunable inductor of the RF MEMS type.

SUMMARY OF INVENTION

The present invention provides a distributed tunable inductor using DC-contact MEMS switches. A high inductance value is realized using a small length of high impedance line, while a low inductance is realized by reconfiguring the same circuit to yield a low impedance line using DC-contact switches.

In accordance with the present invention, a tunable radio frequency microelectromechanical inductor is provided. The tunable inductor includes a coplanar waveguide having a center conductor and two spaced apart ground conductors, the center conductor being positioned between the two spaced apart ground conductors, and the center conductor further including a narrow width inductive section. The RF MEMS inductor further includes at least one direct current actuatable contact switch positioned to vary the effective width of the narrow inductive section of the center conductor upon actuation of the at least one contact switch and a direct current bias line positioned to actuate the at least one actuatable contact switch.

A high inductance value is realized using a small length of high impedance line, which is provided by the narrow width inductive section of the center conductor. In a specific embodiment, this narrow width inductive section is of uniform width over the length of the small length section. In an additional embodiment, the center conductor is a meandered center conductor over the length of the narrow width section, thereby increasing the inductance ratio of the device.

In accordance with the present invention, the actuatable contact switch is in contact at one end with the center conductor and suspended above the coplanar waveguide bordering the narrow inductive section of the center conductor, such that upon actuation, the contact switch increases the effective width of the narrow inductive section, which in turn narrows the slot width between the center conductor and the ground conductor, resulting in a lower inductance value along the transmission line. Alternatively, the actuatable contact switch may be positioned on either or both of the ground conductors of the coplanar waveguide.

In a specific embodiment, the actuatable contact switch of the tunable inductor is a cantilever beam. The cantilever beam is positioned with one end in contact with the wider portion of the center conductor at one end of the narrow width section through a standoff post and then suspended over the length of the narrow width section with the other end of the cantilever positioned to make contact with the wider portion of the center conductor at the opposite end of the narrow section. Upon application of the DC bias to the DC bias line positioned below the cantilever beam, the cantilever beam is actuated, thereby bridging across the narrow section of the center conductor and increasing the effective width of the narrow section.

While many dimensions of the tunable RF MEMS inductor are within the scope of the present invention, in a particular embodiment, the cantilever beam has a width of approximately 50 μm and the narrow width section of the center conductor is approximately 600 μm.

To provide the DC bias to actuate the switches, a SiCr bias line passes through a cut made in the ground plane of the ground conductors and under the actuatable switch. To reestablish the connectivity between the two split sections of the ground conductors resulting from the cut, a thin wire-bond or an air-bridge is provided.

In a particular embodiment, a plurality of direct current actuatable contact switches are provided and in a preferred embodiment an actuatable contact switch is positioned on each side of the narrow width inductive section of the center conductor.

In an additional embodiment of the invention, a thermally actuated diamond micro-bridge is presented. The diamond bridges are used to realize RF switches in the microstrip and CPW topology. As such an electrically actuated NCD bridge utilizing high power RF is provided.

In accordance with the present invention is provided, a tunable RF MEMS inductor in which the tuning functionality is directly integrated into the inductor itself. The resulting inductor is compact in size, provides very fine resolution in its tuning states, and can be applied in a variety of different circuit applications. These applications include, but are not limited to, true-time-delay phase shifters, impedance matching networks for amplifiers, and tuning networks for couplers and filters.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
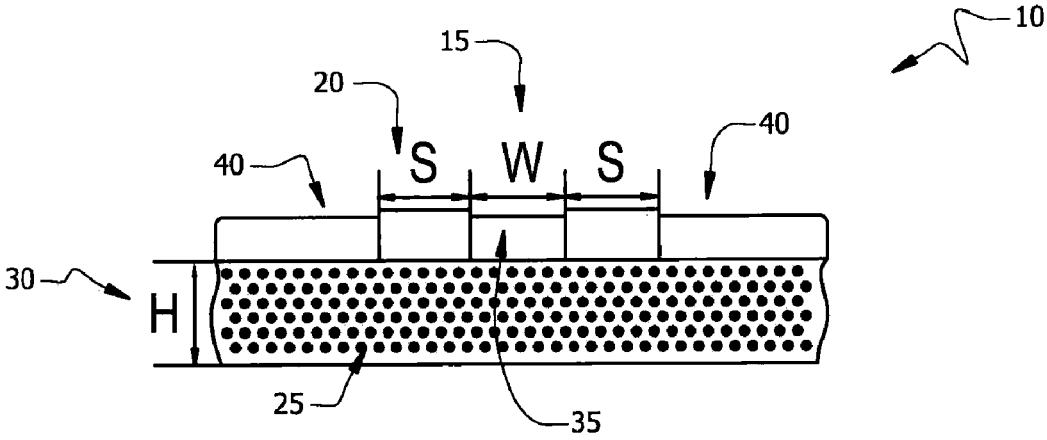
FIG. 1 (Prior Art)
FIG. 1 is a schematic illustration of the cross-section of a coplanar waveguide as known in the prior art.

Coplanar waveguide (CPW) transmission lines are known in the art. With reference to FIG. 1, a CPW transmission line 10 consists of a center conductor 35 positioned between two ground conductors 40. The physical parameters that affect the impedance of a CPW transmission line 10 are the conductor width (W) 15, slot width (S) 20, dielectric constant of the substrate ($\in_r$) 25, and the thickness (H) of the substrate 30. For a given dielectric constant 25 and the substrate thickness 30, a narrow width center conductor and a wide slot width result in high impedance. On the contrary, wide center conductor and a narrow slot width results in low impedance.

Figure 2:
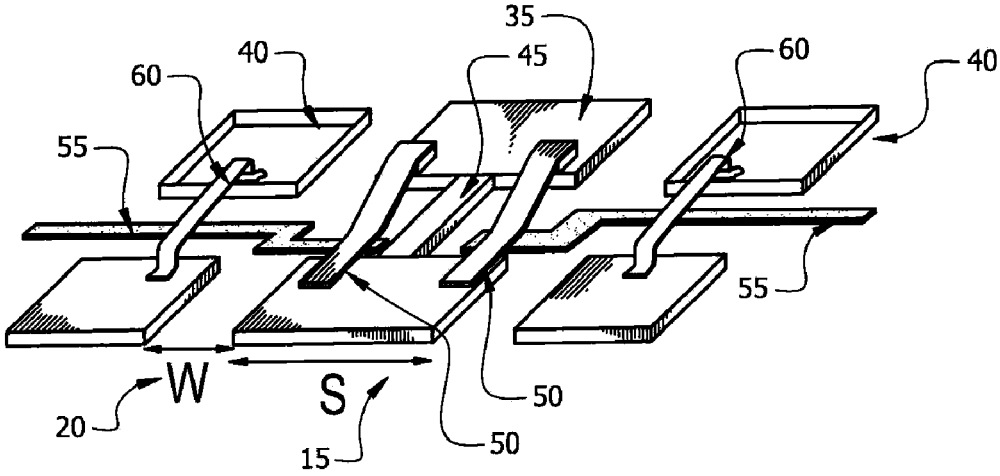
FIG. 2 is three-dimensional diagrammatic view of an embodiment of the tunable radio frequency microelectromechanical inductor in accordance with the present invention having cantilever beams positioned on the center conductor of the transmission line.

With reference to FIG. 2, in accordance with the present invention, a short length 35 of high impedance CPW transmission line is designed to emulate an inductor. In a particular embodiment, the short length 35 is approximately less than or equal to one quarter-wavelength $\lambda/4$. As such, in accordance with the present invention a digital type tuning of the transmission line inductor is made possible by changing the effective width 15 of the center conductor 35 and the slot width 20 using DC-contact switches 50.

In a first embodiment, a tunable inductor with DC-contact switches 50 on the center conductor 35 of a CPW transmission line 10 is described. With reference to FIG. 2 is shown an illustrative view of the tunable inductor in accordance with the present invention. The DC-contact switches 50 are located on the center conductor 35 and suspended above the CPW structure 10. In a particular embodiment, the switches 50 are suspended approximately 2 μm above the CPW structure 10. When the switches 50 are in the non-actuated state, the effective impedance of the microelectromechanical (MEM) section is high (narrow W and wide S), thereby resulting in a high inductance. Furthermore, when the switches 50 are actuated, the effective impedance of the MEM section is low (wide W and narrow S) thereby providing a low inductance. In this embodiment, the width of the narrow section 45 of the center conductor 35 is varied by actuation of the switches 50. Actuation of the switches 50 is accomplished by the placement of DC bias lines 55 through the ground plane 40. A cut in the ground plane is provided to minimize signal leakage. The two split ground sections of ground plane 40 are separated by a cut and reconnected through the use of a thin-wire bond 60.

Figure 3:
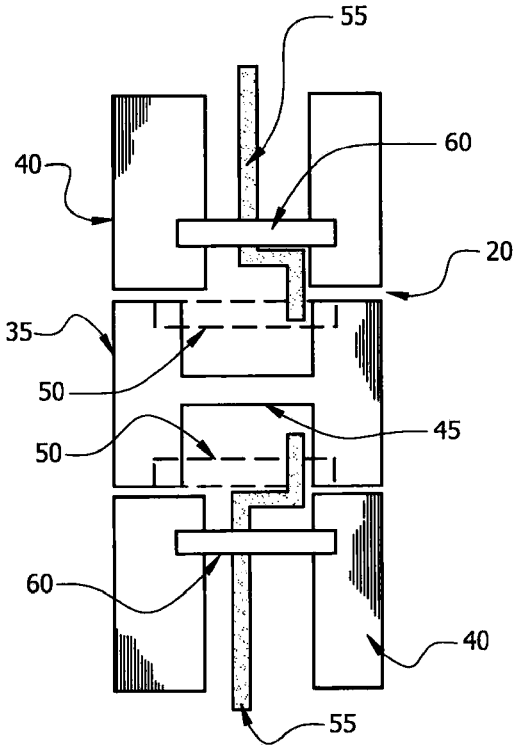
FIG. 3 is a diagrammatic view of an embodiment of the tunable radio frequency microelectromechanical inductor in accordance with the present invention illustrating a uniform narrow width inductive section of the center conductor.
Figure 4:
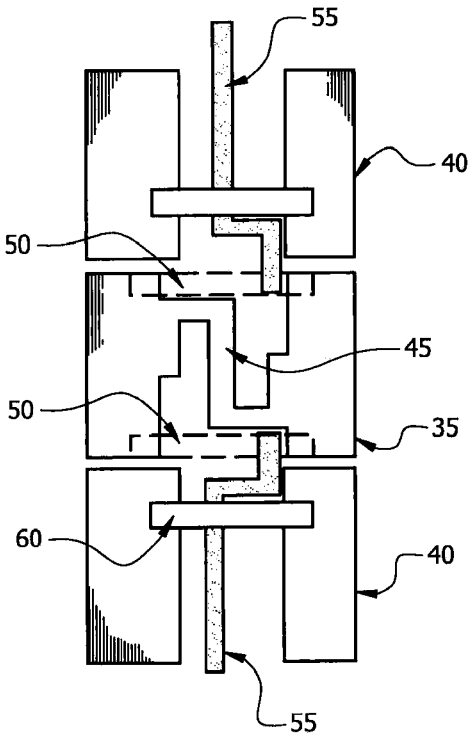
FIG. 4 is a diagrammatic view of an embodiment of the tunable radio frequency microelectromechanical inductor in accordance with the present invention illustrating a meandered narrow width inductive section of the center conductor.

FIG. 3 and FIG. 4 illustrate schematics of the tunable MEMS inductor. In FIG. 3, the narrow center conductor 45 is a uniform high impedance line. In FIG. 4, the inductance ratio is increased by using a meandered center conductor 45. In a particular embodiment, the overall length of the inductive section for both designs is approximately 600 μm and the width of the cantilever beams is approximately 50 μm.

In a particular embodiment, the distributed tunable inductor is designed to operate from 5-30 GHz using DC-contact MEMS switches on a 500 μm thick quartz substrate. A high inductance value is realized using a small length of high impedance line, while a low inductance is realized by reconfiguring the same circuit to yield a low impedance line using DC-contact switches. In a specific embodiment, cantilever beams 50 are used as series type DC-contact switches, suspended on 1.5 μm thick posts that are located on the center conductor 35. When the beams are in the non-actuated state, the signal is carried only on the thin center conductor 45 of the CPW line and a high value of characteristic impedance is obtained. Since the length of the narrow section is electrically small the topology effectively emulates an inductor with high inductance value. Similarly, when the beams make contact, the effective width of the center conductor 45 increases and the characteristic impedance with respect to the high impedance state is less; correspondingly, this represents a low inductance state. The inductance ratio is directly related to the change in the impedance states.

Figure 5:
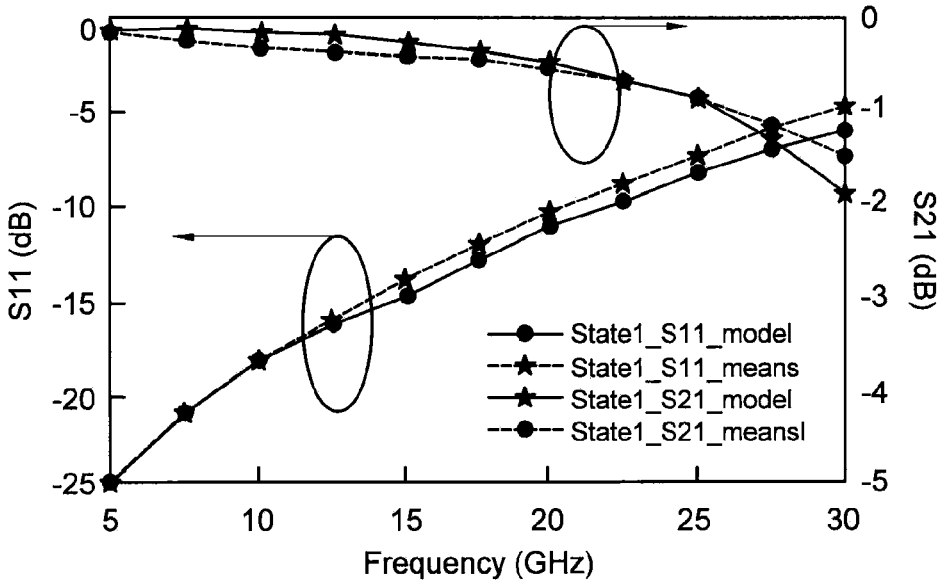
FIG. 5 is a graph illustrating the comparison between the measured and modeled data of the tunable inductor in accordance with the present invention when the DC-switches are in the non-actuated state.
Figure 6:
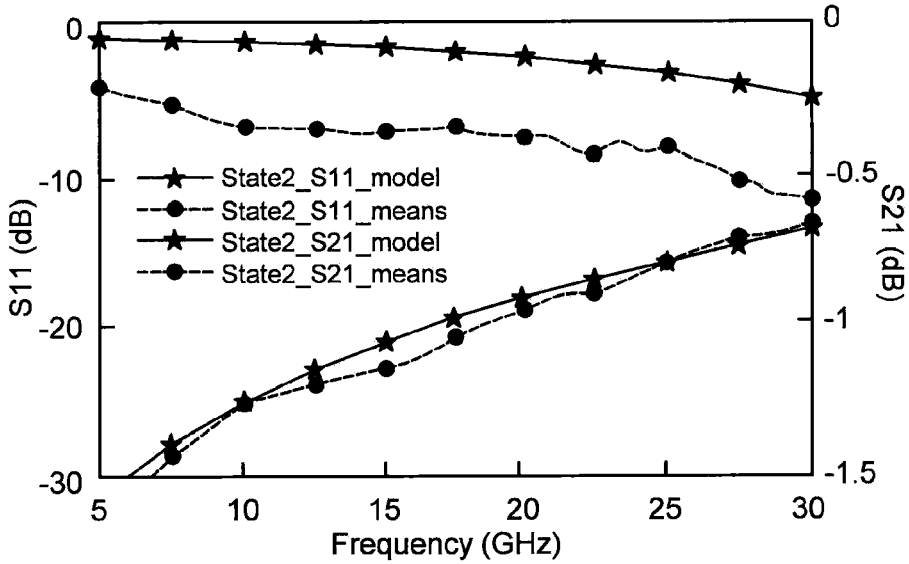
FIG. 6 is a graph illustrating the comparison between the measured and modeled data of the tunable inductor in accordance with the present invention when the DC-switches are in the actuated state.

FIG. 5 and FIG. 6 illustrate the measured and modeled $S_{11}$ and $S_{21}$ for the tunable inductor in two states. FIG. 5 illustrates a comparison between the measured and modeled data of the tunable inductor in state 1, in which the DC-switches are in the non-actuated state. Solid lines represent the modeled data and dotted lines represent the measured data. The modeled data pertains to full wave electromagnetic (EM) simulations. FIG. 6 illustrates a comparison between the measured and modeled data of the tunable inductor in state 2, in which the DC-switches are actuated. Again, solid lines represent the modeled data and dotted lines represent the measured data.

Figure 7:
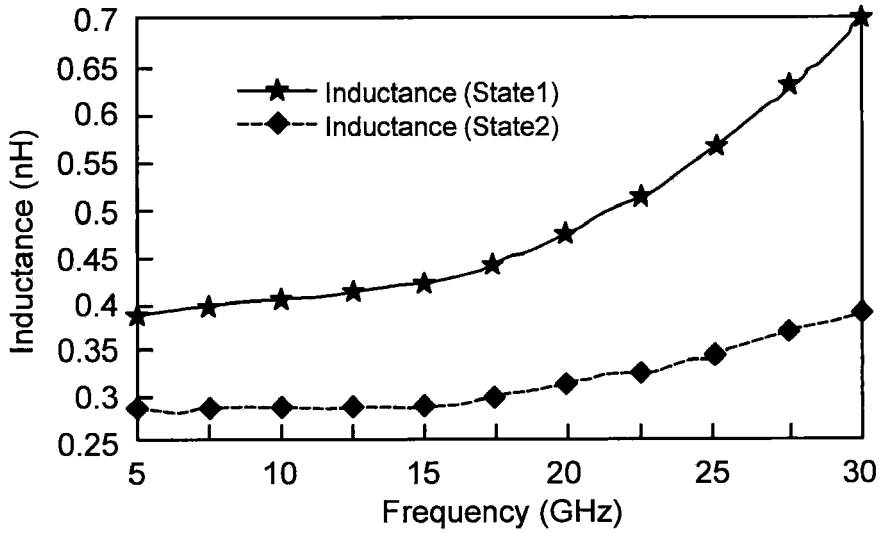
FIG. 7 is a graph illustrating the extracted inductance of the tunable inductor in accordance with the present invention in the non-actuated (state 1) and actuated (state 2) states.

The extracted inductance versus frequency in both states (actuated and non-actuated) is shown in FIG. 7. It is seen from this figure that the inductance ratio (inductance in the high impedance state with respect to the inductance in the low impedance state) is approximately 1.8 at 30 GHz.

In an additional embodiment the switch is a thermally actuated nanocrystalline diamond micro-bridge. The diamond micro-bridge allows for RF and high power applications.

Figure 8:
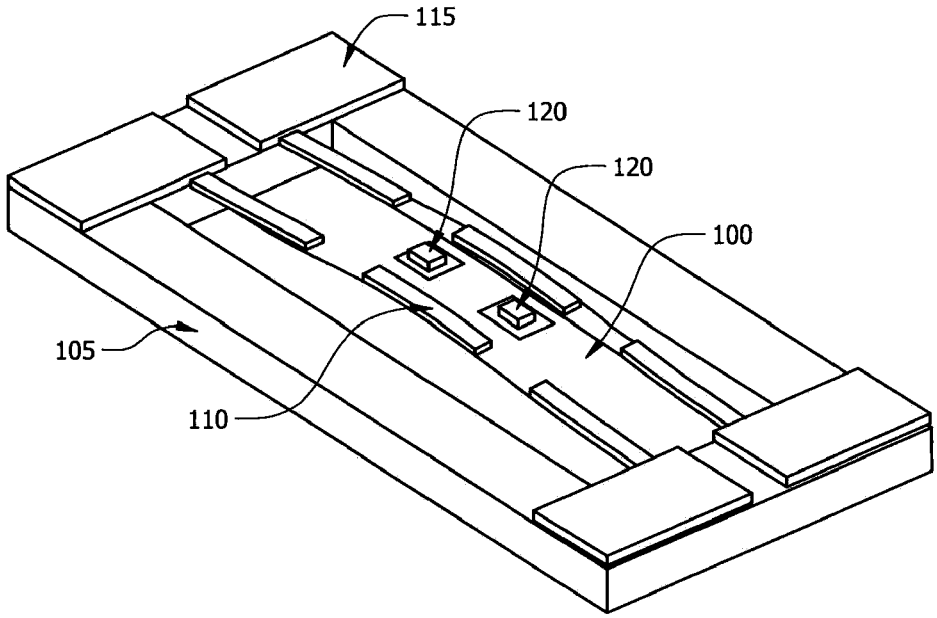
FIG. 8 is a diagrammatic view of an embodiment of the thermally actuated diamond micro-bridge in accordance with the present invention.

With reference to FIG. 8, the design and fabrication of the nanocrystalline diamond bridges 100 includes depositing a nanocrystalline diamond film onto a low resistive silicon substrate 105 by hot filament chemical vapor deposition (HFCVD). In a specific embodiment, the diamond bridge 100 is 1200 μm long and 300 μm wide. The bridges 100 are thermally actuated using a bi-metal actuation scheme. The diamond bridge is made of doped diamond onto which bi-metal copper lines 110 are deposited. As the thermal expansion of copper 110 is higher than that of diamond 100, resistive heating of the doped areas forces a bending of the beam 100 and hence switching into the actuated state. The pull-in voltage (and current) to switch the bridge 100 depends on the geometry of the diamond heating elements.

In a specific embodiment, fabrication of the diamond bridges 100 onto a 500 μm thick low resistive silicon wafer 105 includes:

1. The silicon wafer 105 is nucleated by BEN (bias enhanced nucleation) and an intrinsic diamond layer of 1500 Å in thickness is grown through a microwave plasma assisted CVD process. Boron doped diamond (p-type) is later grown with HFCVD (hot filament CVD) to a thickness of 8500 Å. This boron doped diamond is the heart of the micromachined actuator.

2. Intrinsic diamond is selectively grown using a $SiO_2$ mask. The 4000 Å thick diamond layer is used for electrical isolation of the contact areas while actuating the bridges.

3. A Cr/Au seed layer of 700 Å is deposited using an ion beam reactor following which a 1 μm thick copper film 110 is deposited by electroplating which serves as the bi-metal for thermal actuation.

4. Copper pads 115 which are used to integrate the diamond switches onto the host substrate are electroplated to a thickness of 12 μm. The RF contact areas 120 are also formed by electroplating in this step.

5. The previously deposited seed layer is patterned to provide electrical continuity to actuate the bridges.

6. 400 Å of platinum is patterned over the copper contact area using lift-off technique.

7. Diamond bridges are then etched in a RIE system using titanium as the hard mask.

8. Finally, using patterned silicon dioxide as a backside hard mask, diamond structures are released from the silicon wafer through a DRIE process resulting in a free standing diamond bridge 100 that is embedded in a silicon frame 105.

Figure 9:
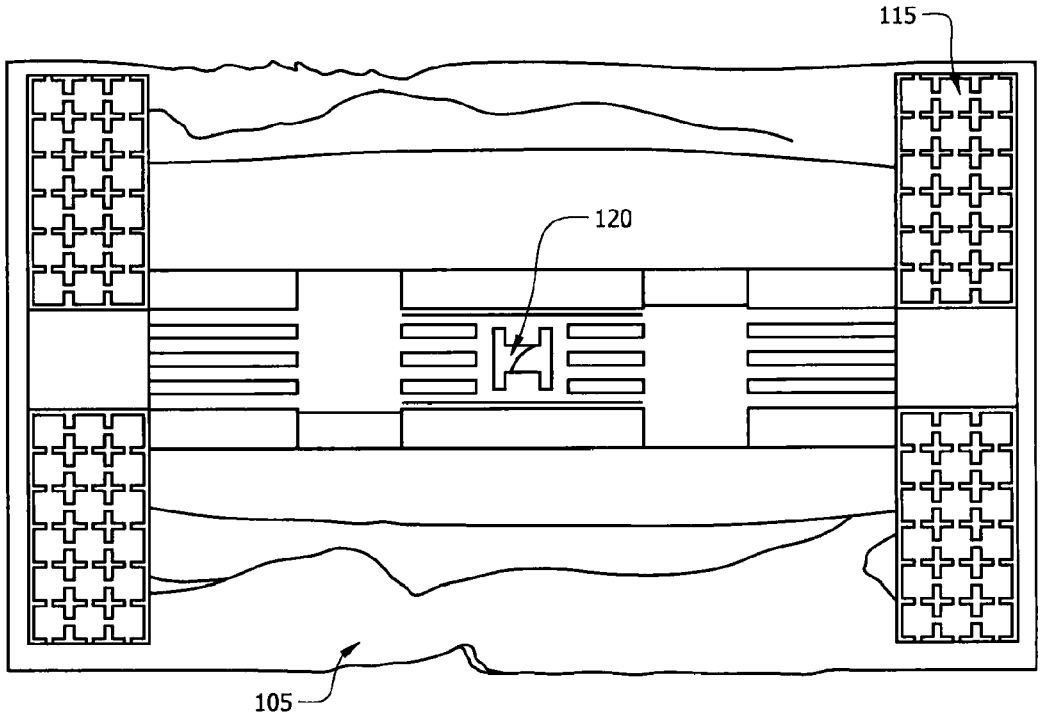
FIG. 9 is a microphotograph of the fabricated diamond air-bridge in accordance with the present invention.

The diamond bridges are then flip-chip bonded to the host substrate using a Cu/Sn solder process (SOLID, solid state interdiffusion). Coplanar waveguide (CPW) and microstrip circuits are gold electroplated on a 650 μm thick alumina substrate. FIG. 9 is a microphotograph of the fabricated diamond actuator in accordance with the present invention. In this embodiment, the overall size of the entire chip is 1600 μm long and 900 μm wide.

In accordance with the present invention, the diamond air-bridges are integrated on an alumina substrate to realize an RF switch in the CPW and microstrip topology. Planar inductors are also realized in the CPW topology using these diamond bridges.

In a specific embodiment, the CPW transmission lines are designed on a 650 μm thick alumina substrate. The transmission lines are 3000 μm long with a center conductor width (W) of 100 μm and slot width (G) of 50 μm. The center conductor of these lines is purposefully interrupted in the middle resulting in two transmission lines which are 1475 μm long; during actuation, the contact pad in the diamond bridge closes this gap.

Figure 10:
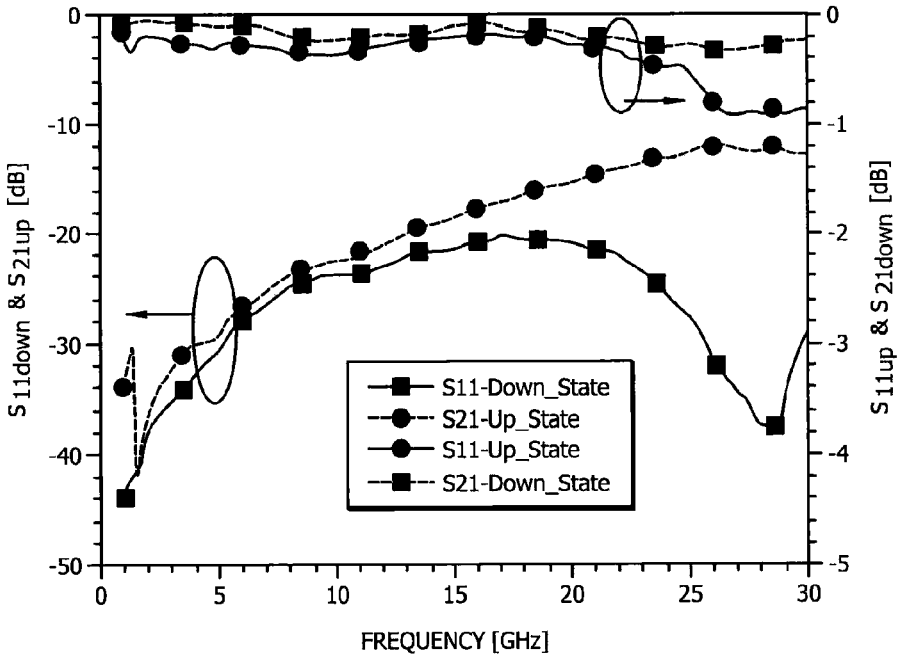
FIG. 10 is a graphical illustration of the measured $S_{11}$ and $S_{21}$ of the CPW switch in the non-actuated and actuated state of the diamond bridge.

FIG. 10 illustrates the measured $S_{11}$ and $S_{21}$ of the CPW switch in the non-actuated and actuated state of the diamond bridge. In this embodiment, the diamond bridges were thermally actuated at 2 volts wherein the platinum coated copper pad makes contact with the CPW line. As illustrated, the return loss and insertion loss in the actuated state are 20 dB and 0.2 dB at 20 GHz. It is evident from the s-parameters, that in the actuated state, the diamond bridge makes a very good contact with the transmission line with little contact resistance. Similar to the CPW circuits, diamond bridges may also be integrated into alumina substrates with microstrip transmission lines.

Figure 11:
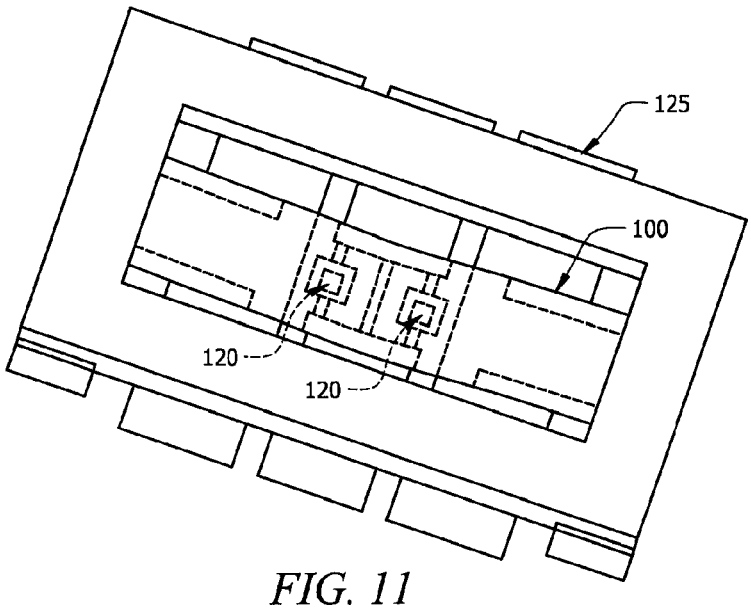
FIG. 11 is an illustration of the design of the integrated CPW inductor and diamond actuator in accordance with an embodiment of the present invention.

With reference to FIG. 11, in an additional embodiment, the diamond bridges 100 are utilized to realize tunable inductors wherein the non-actuated and actuated-sate of the bridges yield different net inductance values. In this embodiment, the inductor circuits 125 fabricated on the alumina substrate are 400 μm long. FIG. 11 illustrates the inductor layout 125 along with the integrated diamond bridge 100. The difference in inductance is due to the change in impedance of the device due to the varying widths of W and G.

Figure 12:
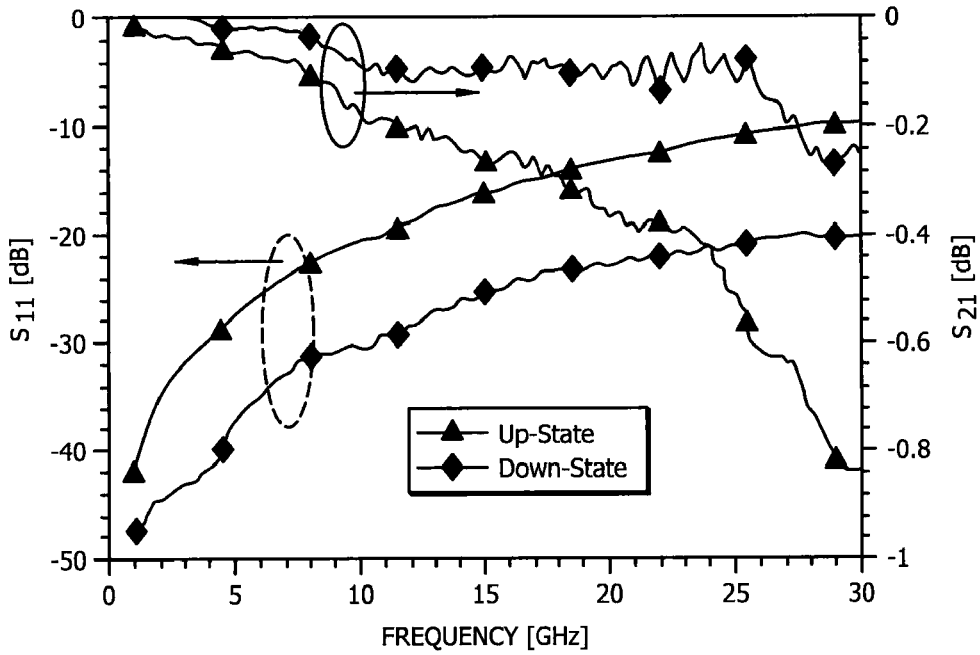
FIG. 12 is a graphical illustration of the measured $S_{11}$ and $S_{21}$ of the tunable inductor and the diamond actuated in the non-actuated and actuated state.
Figure 13:
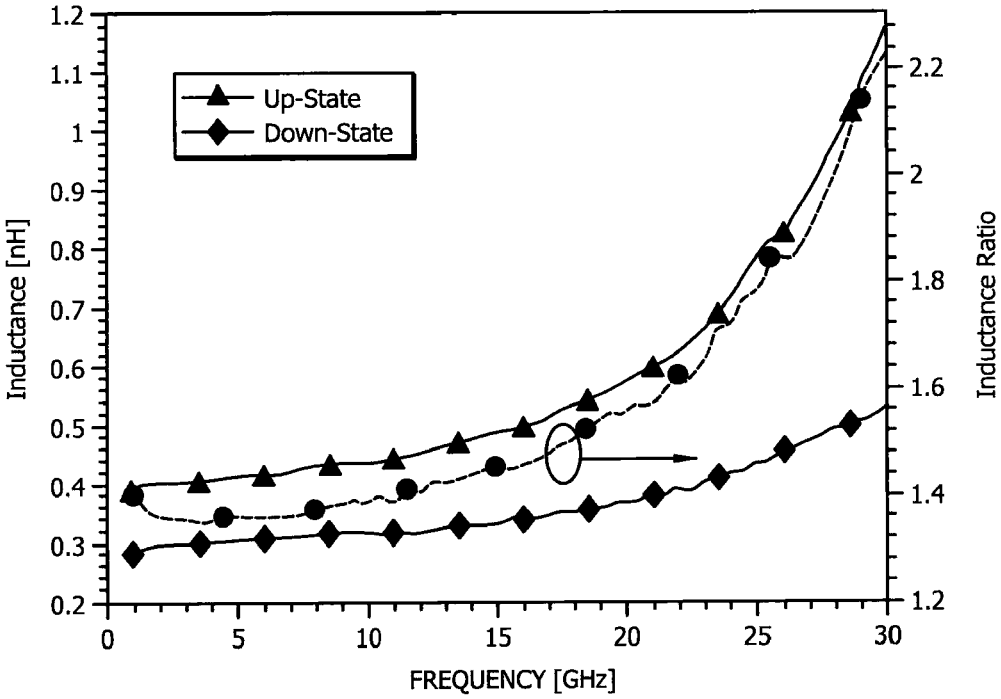
FIG. 13 is a graphical illustration of the measured inductance in the two states and the inductance ratio of the tunable inductor and the diamond actuator.

FIG. 12 illustrates the insertion loss and the return loss of the tunable inductor in the non-actuated and the actuated state of the diamond bridge. The measured inductance in the two states and the inductance ratio are shown with reference to FIG. 13, an inductance ratio of 2.2 was achieved at 30 GHz with 1.2 nH being the maximum inductance value.

Accordingly, the present invention provides a planar MEMS tunable inductor utilizing series cantilever beams that are DC-contact type switches to vary the effective width of a CPW center conductor.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A tunable radio frequency microelectromechanical inductor, the inductor comprising:

a coplanar waveguide having a center conductor and two spaced apart ground conductors, the center conductor positioned between the two spaced apart ground conductors, and the center conductor further comprising a narrow width inductive section;

at least one direct current actuatable diamond micro-bridge contact switch positioned to vary the effective width of the narrow inductive section of the center conductor upon actuation of the at least one contact switch; and a direct current bias line positioned to actuate the at least one actuatable diamond micro-bridge contact switch.

2. The tunable inductor of claim 1, wherein the inductive section of the center conductor is substantially straight and of uniform width over the length of the section.

3. The tunable inductor of claim 1, wherein the inductive section of the center conductor is a meandered center conductor over the length of the section.

4. The tunable inductor of claim 1, wherein the actuatable contact switch is in contact at one end with the center conductor and suspended above the coplanar waveguide bordering the narrow inductive section of the center conductor.

5. The tunable inductor of claim 1, wherein the actuatable contact switch is a boron-doped diamond micro-bridge having deposited bi-metal copper lines.

6. The tunable inductor of claim 1, wherein the diamond micro-bridge is about 1200 μm long and 300 μm wide.

7. The tunable inductor of claim 1, wherein the diamond micro-bridge is thermally actuatable using a bi-metal actuation scheme.

8. The tunable inductor of claim 1, wherein the direct current bias line passes through a cut in the ground plane of the ground conductors and under the actuatable switch.

9. The tunable inductor of claim 1, wherein the direct current bias line is a SiCr line passing through a cut in the ground plane of the ground conductors and the ground planes split by the cut are electrically connected through a thin wire-bond.

10. The tunable inductor of claim 1, wherein the direct current bias line is a SiCr line passing through a cut in the ground plane of the ground conductors and the ground planes split by the cut are electrically connected through an air-bridge.

11. The tunable inductor of claim 1, wherein the at least one direct current actuatable diamond micro-bridge contact switch further comprises a plurality of direct current actuatable diamond micro-bridge contact switches.

12. The tunable inductor of claim 1, wherein the length of the narrow width inductive section of the center conductor is equal to approximately one fourth of an operating wavelength of the inductor.

13. The tunable inductor of claim 1, wherein the length of the inductive section is approximately 600 μm.

14. A method of tuning a radio frequency microelectromechanical inductor, the method comprising the steps of:

providing a coplanar waveguide having a center conductor and two spaced apart ground conductors, the center conductor positioned between the two spaced apart ground conductors, and the center conductor further comprising a narrow width inductive section;

positioning at least one direct current actuatable diamond micro-bridge contact switch to vary the effective width of the narrow inductive section of the center conductor upon actuation of the at least one contact switch; and positioning a direct current bias line to actuate the at least one actuatable diamond micro-bridge contact switch.

15. A tunable radio frequency microelectromechanical inductor, the inductor comprising:

a coplanar waveguide having a center conductor and two spaced apart ground conductors, the center conductor positioned between the two spaced apart ground conductors, and the center conductor further comprising a narrow width inductive section;

two diamond micro-bridges positioned on opposite sides of the narrow inductive width section and spanning the narrow width induction section, the diamond micro-bridges positioned to vary the effective width of the narrow inductive section of the center conductor upon actuation of the two diamond micro-bridges; and a direct current bias line positioned to actuate the two diamond micro-bridges, the bias line passing through a cut in the ground plane of the ground conductors and the ground planes split by the cut being electrically connected through a thin wire-bond.

* * * * *